United States Patent [19]

Stewart

[11] Patent Number: 4,907,777

[45] Date of Patent: Mar. 13, 1990

[54] BOOKHOLDER FOR RECLINED READING

[76] Inventor: Richard M. Stewart, 236 Central Rd., Middlebury, Conn. 06762

[21] Appl. No.: 221

[22] Filed: Jan. 2, 1987

[51] Int. Cl.[4] ..... A47B 23/00

[52] U.S. Cl. ..... 248/453; 248/444.1; 248/458

[58] Field of Search ..... 248/453, 454, 449, 458, 248/445, 444.1, 126

[56] References Cited

U.S. PATENT DOCUMENTS

| | | | |
|---|---|---|---|
| 1,246,859 | 11/1917 | Boyd | 248/454 |
| 1,602,463 | 9/1926 | White et al. | 248/453 X |
| 2,489,553 | 11/1949 | Wofford | 248/449 X |
| 2,503,015 | 4/1950 | Weisheit | 248/453 |
| 3,863,882 | 2/1975 | Hatcher | 248/453 |
| 4,140,296 | 2/1979 | Guillen | 248/445 |
| 4,191,354 | 3/1980 | Chia-Liu | 248/445 |
| 4,553,728 | 11/1985 | Corsello | 248/449 X |

FOREIGN PATENT DOCUMENTS

| | | | |
|---|---|---|---|
| 80886 | 8/1951 | Czechoslovakia | 248/453 |

*Primary Examiner*—Ramon S. Britts
*Assistant Examiner*—Karen J. Chotkowski
*Attorney, Agent, or Firm*—William C. Crutcher

[57] ABSTRACT

A bookholder for reclined reading includes a support arm assembly of two arms meeting at a right angle and extending upwardly at approximately 45° from the horizontal. The support arms provide ledges for supporting the bottom and one side of an open book at a 45° angle. The ledges have a plurality of holes for selective insertion of pegs to hold the book and its pages in place.

The support arm assembly is pivotably supported on a backwall member, which in turn is supported on a base member. In a modified form the support arm assembly is fixed rather than pivotable. The ledges include notches to optionally support a book in the horizontal position. A lamp for night time reading is incorporated into an open box structure in the base member.

9 Claims, 3 Drawing Sheets

BOOKHOLDER FOR RECLINED READING

BACKGROUND OF THE INVENTION

Bookholders are well-known in the art for supporting a book, magazine, or the like in an open position and holding the pages in place to reduce fatigue on the reader or to permit other activity while reading. In order to be useful, such bookholders permit the pages to be individually turned and held in place temporarily until the reader desires to turn an additional page. Bookholders must also be able to accommodate a variety of shapes, sizes, and thicknesses of books, magazines, or the like. Hence, adjustability and flexibility of a bookholder is a desirable attribute.

A bookholder having a base, a backwall, and a ledge for supporting a bottom of an open book is shown in U.S. Pat. No. 2,595,682 to Lipa. Lipa provides pivotable fingers on the ledge for holding the pages open. The Lipa bookholder is useful for holding the pages so that they can be read in a horizontal position. However, if the reader desires to read while reclining on his side in bed, the Lipa bookholder would not be satisfactory.

U.S. Pat. No. 236,685 issued to Massey on Jan. 18, 1881 discloses a book rest for holding the covers of a book and rotating it through various angles, but it requires a tripod stand, and is unsuitable for reading in bed.

U.S. Pat. No. 1,938,528 issued Dec. 5, 1933 to Marseglia describes an adjustable bookholder intended for a reader reclining in bed, comprising a frame work of wire members, which holds an open book on its side. An inclined wire frame supports one side of the book and includes adjustable legs. A pivotable arm holds the other side of the book in an open position so that the lines of print run in a vertical direction. While this bookholder may be suitable for reading when the reader is lying fully in a horizontal position so that the eyes may sweep in a vertical direction, it is unsuitable for reading when the reader is reclined or propped up in bed at some selected angle other than horizontal. Also illumination of the pages for night reading would be desirable so as not to disturb other people. Preferably, also, a bookholder for reading in bed should be a design which provides a pleasing appearance suitable for display and which has other uses.

Accordingly, one object of the present invention is to provide an improved bookholder for reclined reading.

Another object of the present invention is to provide an improved bookholder for reading at night.

Still another object of the invention is to provide an attractive and useful bookholder for a bedroom and for reading in bed.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing in which:

Figure 1:
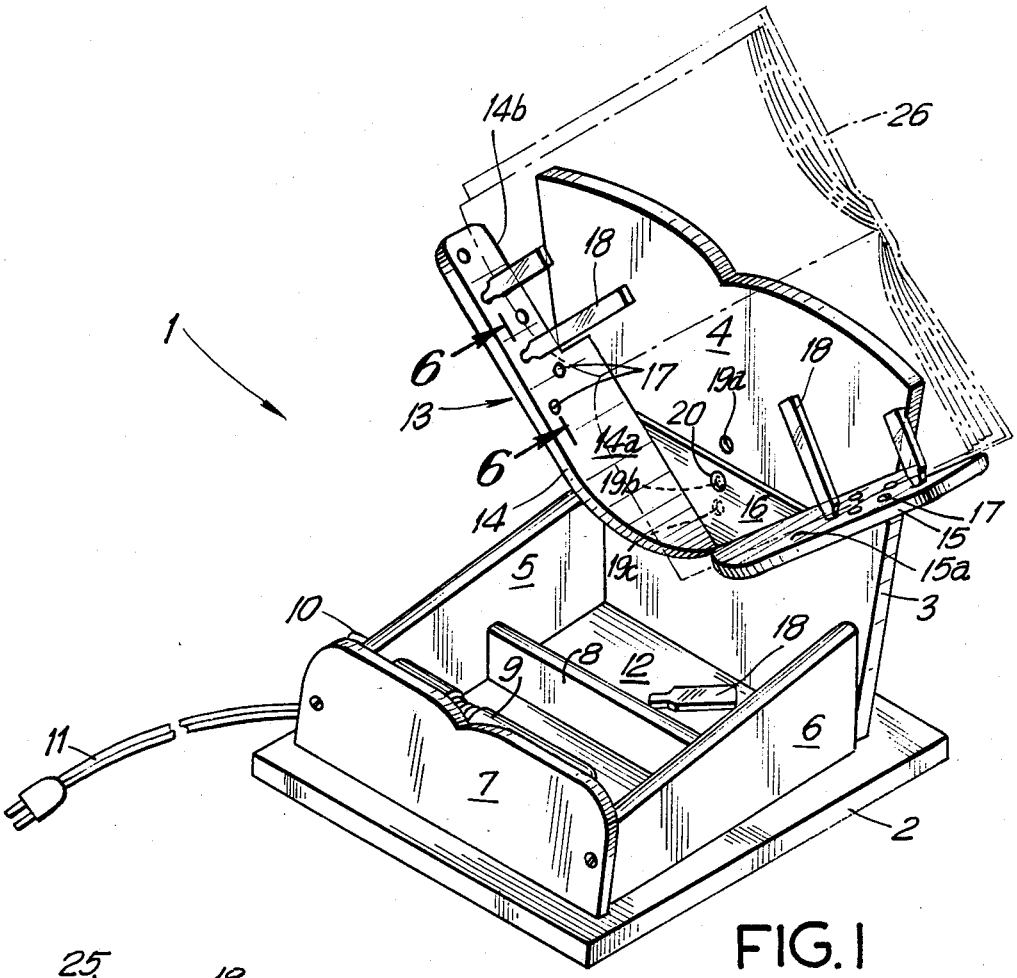
FIG. 1 is a perspective view of my improved bookholder.
Figure 6:
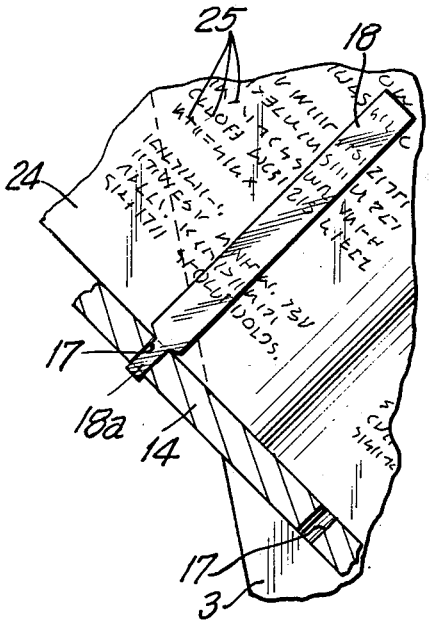
Figure 3:
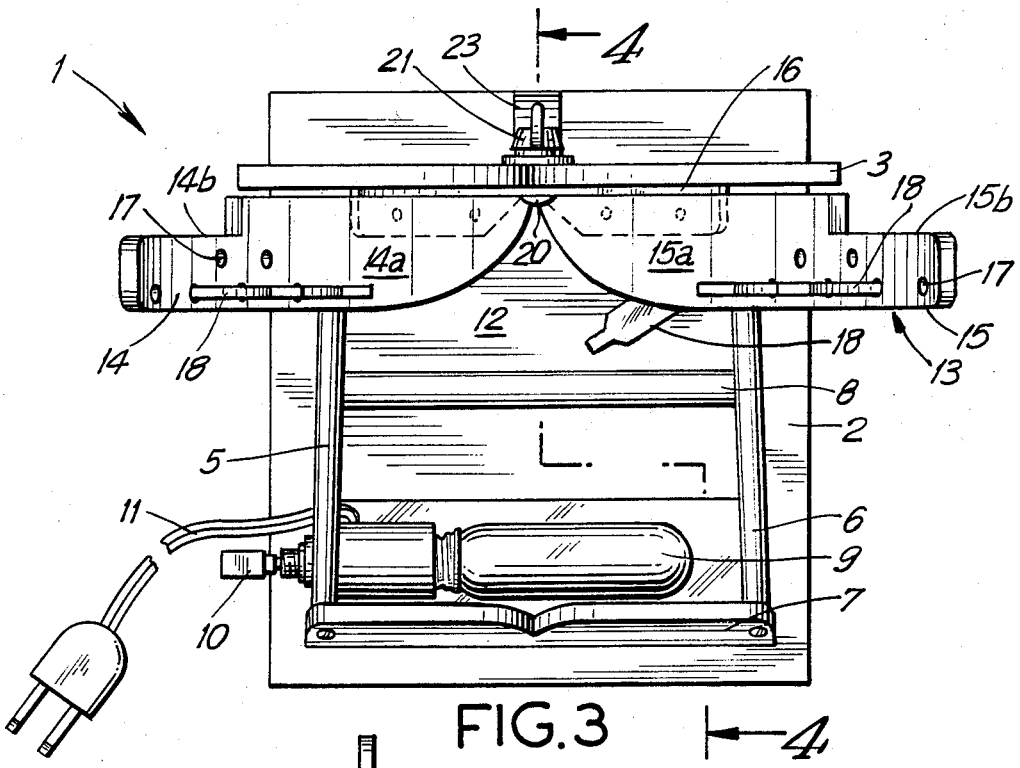
FIG. 3 is a top plan view thereof.
Figure 5:
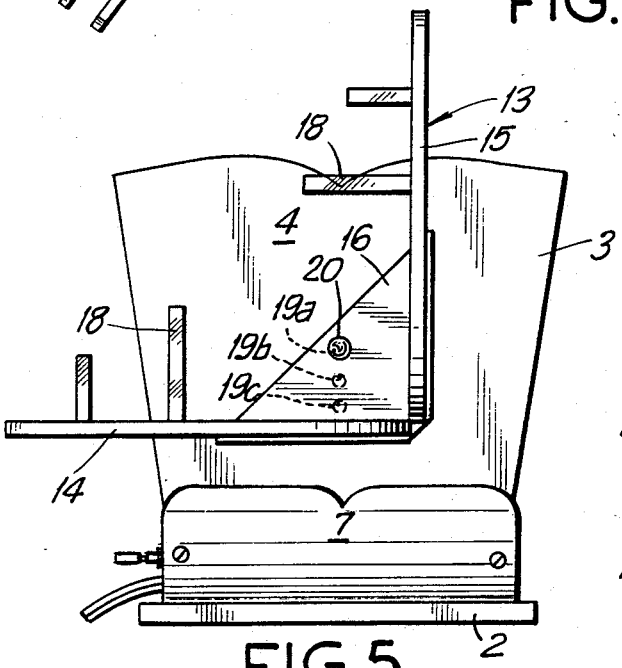
Figure 4:
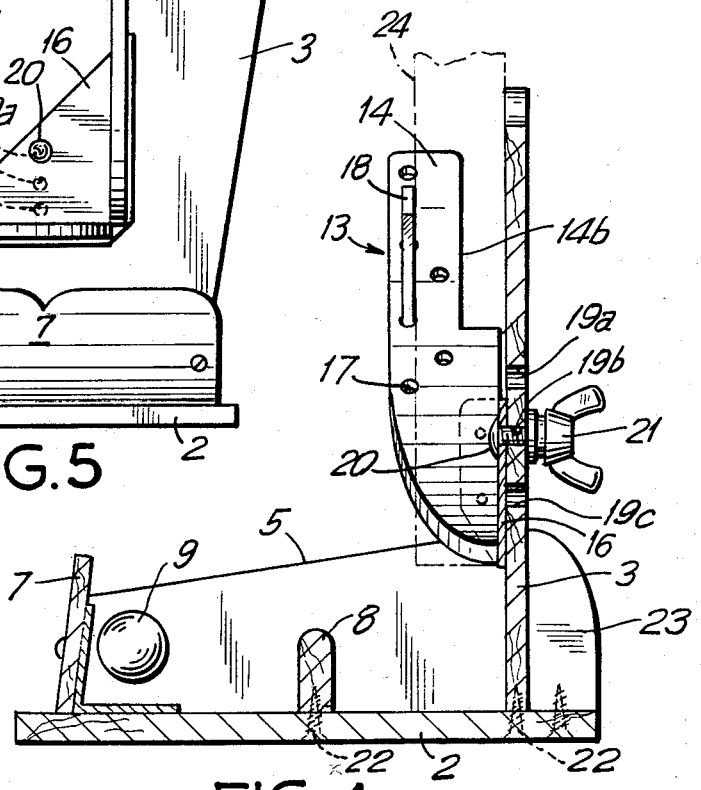
Figure 9:
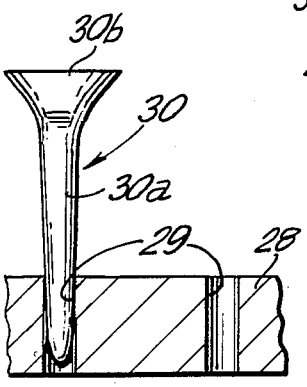
Figure 7:
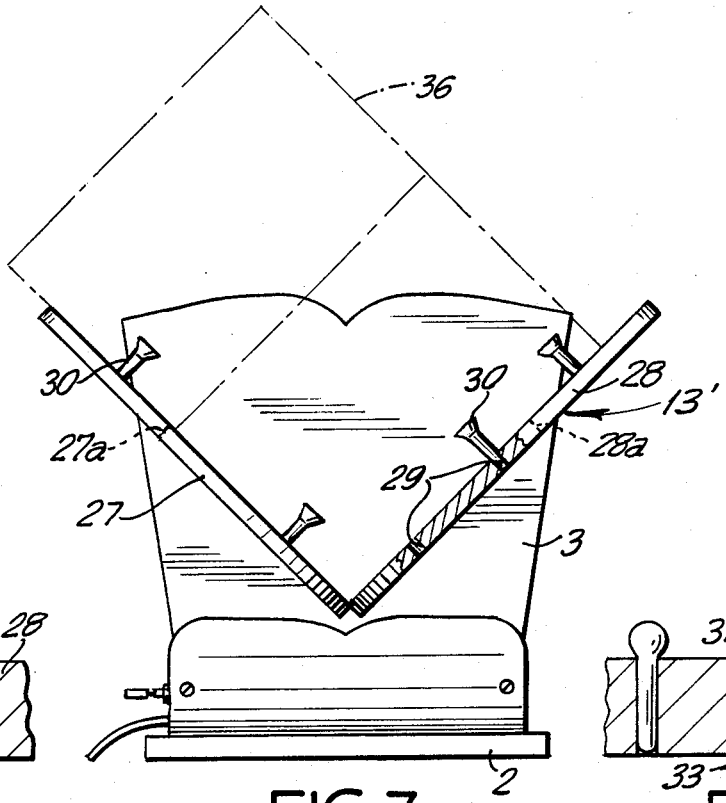
Figure 10:
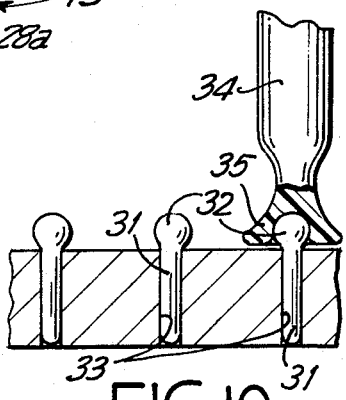
Figure 11:
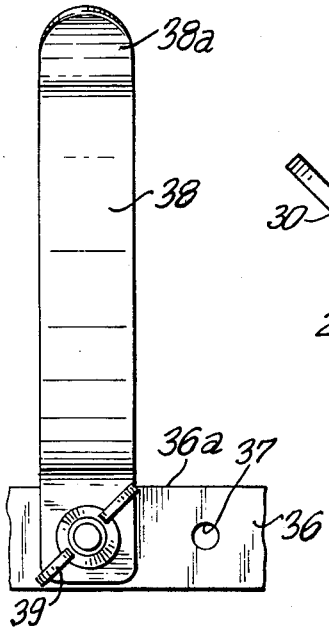
Figure 8:
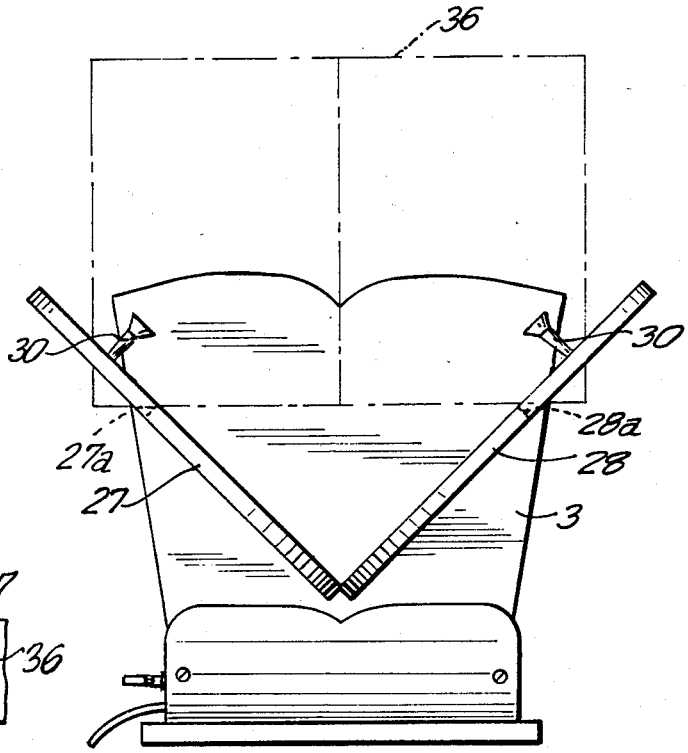
Figure 12:
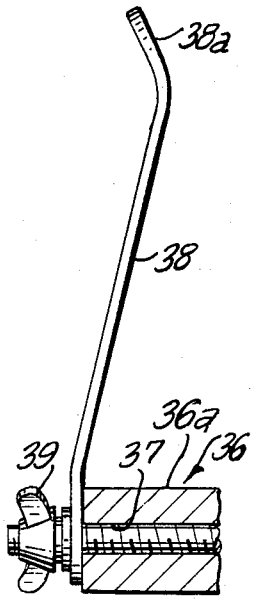

FIG. 4 is a side elevation view thereof, in section, taken along lines 4—4 of FIG. 3, FIG. 5 is a front elevation view thereof, with support arm assembly in a different position, FIG. 6 is an enlarged cross-section partial view of one type of removable peg taken along lines 6—6 of FIG. 1, FIG. 7 is a front elevation view of a modified form of the invention, FIG. 8 is a front elevation view showing an optional use of the FIG. 7 modification, and FIGS. 9 and 10 are enlarged cross-sectional views of alternate types of holding means, and FIGS. 11 and 12 are enlarged front and cross-sectional views of yet another type of holding means.

SUMMARY OF THE INVENTION

Briefly stated, the invention comprises a base member, a backwall member supported from the base, a support arm assembly attached to the backwall member comprising a pair of support arms meeting at a right angle and forming ledges for supporting the bottom edge and one side edge of an open book. The ledges incorporate a plurality of holding means, comprising a plurality of removable pegs for holding the book on the ledges and holding the pages of the book while permitting turning of individual pages. The pegs are relatively small, or in some cases may be transparent so as to provide minimum interference with viewing the printed material on the pages of the book. Preferably, the support arm assembly is pivotable for selectively adjusting the angle at which the book is held to the horizontal, but it may also be fixed at a 45° angle to the horizontal. Illumination means in an open box structure in the base member and the support ledges may include cutouts for optionally holding the book in,a horizontal position.

DESCRIPTION OF THE PREFERRED EMBODIMENT

Referring now to the perspective view of FIG. 1 of the drawing, the preferred form of the bookholder, shown generally as 1, comprises a rectangular base member 2 having attached thereto a backwall member 3, which extends upwardly from the base member at a slight angle and having a planar surface area 4. Included as part of the base member 2 are two upwardly extending, but shorter side wall members 5, 6, and a front wall 7 defining together with a lower section of the backwall 3 a box structure. An interior short partition wall 8 divides the box into a front chamber for holding an incandescent illuminating lamp 9 with switch 10 and electrical cord 11, and for preventing accidential contact with lamp 9. To the rear of partition 8, lies a rear chamber 12 for holding small objects.

Pivotably attached to backwall member 3 is a support arm assembly shown generally as 13, which includes a first support arm 14 attached to a second support arm 15 by means of an angle brace 16, so that arms 14, 15 meet at a right angle. Arms 14, 15 provide ledges **14*a*, 15*a* extending outwardly from the planar surface 4 of the back member 3. A plurality of holes 17 are interspersed along ledges 14*a*, 15*a*. A plurality of removable pegs, such as 18 are held by friction fit in selected holes 17**.

Figure 2:
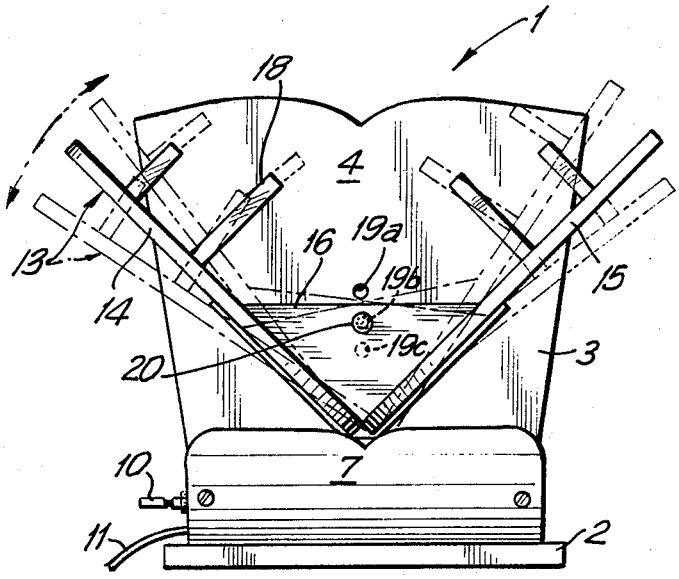
FIG. 2 is a front elevation view thereof.

Referring to FIG. 2 of the drawing, it is seen that the backwall member 3 incorporates three holes, such as **19*a*, 19*b*, and 19*c* for selective insertion of a pivot pin 20 through a hole in angle brace 16**. This permits pivoting of the support arm assembly through a limited range of selectable angles, as shown by the three positions in phantom lines.

Referring to FIG. 3 and FIG. 4 of the drawing, further details of the construction are apparent. The pivot pin 20 is threaded to receive a thumb screw 21, permitting adjustment and tightening of the support arm assembly 13 in a new desired selected position. Other types of adjustable support means may be used, such as additional pins and holes to permit minor adjustments as shown in FIG. 2. Arm 14 is provided with a notch **14*b* cut out of ledge 14*a* near the end of the arm toward the backwall member 3. Arm 15 is provided with a similar notch 15*b***.

Referring to FIG. 4, it is seen that the holes **19*a*, 19*b*, and 19*c*, may be selected for the pivot pin 20 to raise or lower the support arm assembly 13. Other details indicate that the walls such as 7, 8, and 3 are attached to base member 2 by screws, such as 22, and a back brace 23 behind backwall member 3** provides additional support.

Reference to FIG. 5 of the drawing illustrates the support arm assembly 13 placed in its highest position with pivot pin 20 passing through hole **19*a*. When in this position, the assembly 13** may be tilted to the position shown.

FIG. 6 illustrates one type of holding means used with the present invention. A portion of an open book 24 is shown resting on its bottom edge on one of the arms 14. The printed letters are indicated at 25 which run parallel to arm 14. The holding means comprise holes 17 extending through the arm 14 together with pegs 18. Pegs 18 comprise transparent plastic strips of material such as Lucite (Registered Trademark of E.I. du Pont de Nemours & Co.) with a smaller neck **18*a* held by friction in hole 17. Peg 18 holds the page of the book in place, and does not interfere with reading the lines of print 25**.

OPERATION

Referring back to FIG. 1 of the drawing, an open book is indicated in phantom line at 26. The bottom edge of the book is supported on ledge **14*a* of arm 14 and one side edge of the open book is supported on ledge 15*a* of arm 15. Pegs 18 are of various lengths and a supply may be kept in rear chamber 12. These arc selected and inserted in holes 17, which are located in various places along ledges 14*a*, 15*a* to permit placement of pegs 18 in accordance with the shape, size, and thickness of the book and its pages. The assembly 13 is generally positioned with the arms 14, 15 inclined at approximately 45° to the horizontal, as shown. This allows a reader who is reclined at approximately the same angle to read the lines without fatigue, with his/her eyes sweeping parallel to arm 14. If minor adjustment is required, this can be accomplished by loosening and retightening the thumb screw 21 to permit slight pivoting as shown in FIG. 2. Illumination is provided by the lamp 9. When it is desired to turn a page, each page may be slipped from beneath the pegs 18 on one arm and inserted beneath the pegs 18 on the other arm without difficulty. For maximum illumination, the support arm assembly 13 is placed in the lowest position by removing and reinserting pivot pin 20 in the lowest hole 19*c* of the back member. On the other hand, for holding the book in a fully horizontal position, or conversely in a vertical position with the print running in a vertical direction, pivot pin 20 is placed in the top hole 19*a*** as indicated in FIG. 5, so that the arms can pivot to the respective horizontal (or vertical) positions shown.

MODIFICATIONS

The invention is not limited to a pivotable mounting for the arm assembly nor to the particular types of pegs or holding means illustrated in the preferred embodiment.

Referring now to FIGS. 7 and 8 of the drawing, the base member 2 backwall member 3, and box structure are constructed as before. A fixed support arm assembly, shown generally as 13' comprises a first arm 27 and a second arm 28 permanently attached to backwall member 3 at right angles to one another and providing ledges extending from the planar surface 4 of the backwall member as before. Each of the support arms 27, 28 includes a plurality of holding means, comprising holes 29 and a plurality of removable pegs such as 30. The arms 27, 28 incorporate notches **27*a*, 28*a* in the ends of the arms toward the backwall member 3**.

Reference to the details of the enlarged cross-section of FIG. 9 shows that the holding means comprises holes 29 through arm 28, and that the removable pegs 30 are tapered pins with slender bodies **30*a* and enlarged heads 30*b* which press against the pages. Since the body 30*a* of pins 30** are fairly slender, they do no interfere appreciably with reading the printed matter.

FIG. 10 illustrates modified holding means in hhich pins 31 with bulbous protuberances 32 are held by press fit in holes 33 in the support arm. Pegs 34 incorporate expandable sockets 35 on their lower ends, which can be snapped over the pegs 31.

FIGS. 11 and 12 illustrate another type of holding means. A front view of a portion of an arm 36 shows holes 37 drilled parallel to a edge **36*a* holding the book. A plurality of resilient metal strips 38 are selectively attached to the front of the arm 36 by threaded, removable thumbscrew attachments 39. The strips 38 are shaped with a bent end 38*a*** extending in above the ledge toward the backwall member to provide pressure for holding the book and pages in place when the book is resting on the ledge.

OPERATION OF MODIFICATION

Referring to FIG. 7, an open book illustrated by phantom lines 36 is held with its bottom edge supported on the ledge of arm 27 and with one side edge supported on the ledge of arm 28, so that the book is held at substantially a 45° angle from the horizontal. Removable pegs 30 are placed in the appropriate holes 29 to hold the book and pages in place. As before, pages may be turned individually by slipping from beneath pegs 30 on one arm and inserting below pegs 30 on the other arm.

FIG. 8 illustrates an alternate placement of the same book 36 for holding it in a horizontal position. With this method of use, the two sides of the book are slipped into the notches **27*a*, 28*a*** on the respective arms so that the book is held in a horizontal position as shown between the arms and the backwall member.

While there has been shown what is considered to be the preferred embodiment of the invention and illustrative modifications thereof, it is desired to secure in the appended claims all such modifications as fall within the true spirit and scope of the invention.

I claim:

1. A bookholder for reclined reading of a book, comprising, a base member, comprising an open box structure, a backwall member attached to and supported by said base member and having a planar surface extending upwardly from said base member, an illuminating device disposed within the protective confines of said open box structure and arranged for illuminating the pages of said book, a support arm assembly attached to said backwall member, said support arm assembly including first and second support arms disposed at a right angle to one another and defining first and second ledges respectively extending from said planar surface and adapted to support a bottom edge and one side edge, respectively, of said book when it is open, said first arm being inclined at a selected angle to the horizontal, and a plurality of holding means disposed on said arms adapted to be selectively positioned on said arms for holding said book on said ledges according to size and thickness of said book and adapted to hold the pages in place while permitting turning of the individual pages, whereby a reclined reader may view the book with eyes sweeping parallel to said first arm at said selected angle.

2. A bookholder according to claim 1, wherein said support arm assembly is pivotably attached to said backwall member, and including means for adjusting and holding said assembly at a new selected angle.

3. A bookholder according to claim 1, wherein said holding means comprise a plurality of holes in said first and second ledges, and pegs adapted for insertion into said holes with a friction fit.

4. A bookholder according to claim 3, wherein said pegs comprise pin members with slender tapered bodies and enlarged heads.

5. A bookholder according to claim 3, wherein said pegs comprise flat transparent members.

6. A bookholder according to claim 1, wherein said holding means comprise a plurality of resilient strips attached to said arms and having portions above said ledges extending toward said backwall member.

7. A bookholder according to claim 1, wherein said first and second support arms are attached to said backwall member, each at substantially 45° to the horizontal.

8. A bookholder according to claim 1, wherein said first and second arms have outer ends and define first and second notches on the outer ends thereof facing toward said backwall member and adapted for optionally holding said book on its bottom edge in said notches.

9. The combination according to claim 1, wherein said box structure further defines a front chamber containing said illuminating device and a rear chamber adjacent the backwall member adapted for holding small objects.

* * * * *